US010470966B1

(12) United States Patent
Smith Swerdlow

(10) Patent No.: US 10,470,966 B1
(45) Date of Patent: Nov. 12, 2019

(54) WALKER/ROLLATOR

(71) Applicant: Aligned As Designed, LLC, Los Angeles, CA (US)

(72) Inventor: Linda Smith Swerdlow, Los Angeles, CA (US)

(73) Assignee: Aligned As Designed, LLC, Los Angeles, CA (US)

( * ) Notice: Subject to any disclaimer, the term of this patent is extended or adjusted under 35 U.S.C. 154(b) by 0 days.

(21) Appl. No.: 16/007,720

(22) Filed: Jun. 13, 2018

(51) Int. Cl.
*A61H 3/04* (2006.01)

(52) U.S. Cl.
CPC ..... *A61H 3/04* (2013.01); *A61H 2003/046* (2013.01)

(58) Field of Classification Search
CPC ..... A61H 3/04
USPC ..... 135/72
See application file for complete search history.

(56) References Cited

U.S. PATENT DOCUMENTS 86,699 A * 2/1869 Schopp ..... A61H 3/04 482/68
2,847,057 A * 8/1958 Holcombe ..... A61H 3/04 188/5
2,862,544 A * 12/1958 Lilja ..... A61H 3/04 482/68
6,003,532 A * 12/1999 Pi ..... A61H 3/04 135/67
6,070,603 A * 6/2000 Politz ..... A61H 3/04 135/65
6,651,994 B2 * 11/2003 Hallgrimsson ..... A61G 5/08 135/67
6,834,872 B2 * 12/2004 Chen ..... A61H 3/04 135/65
6,976,698 B2 * 12/2005 Kuiken ..... A61G 5/14 280/250.1
7,708,120 B2 * 5/2010 Einbinder ..... A61H 3/04 188/19
7,743,779 B2 * 6/2010 Gee, Sr. ..... A61H 3/04 135/66

(Continued)

FOREIGN PATENT DOCUMENTS

JP 2018164532 A 10/2018
NL 1006269 A1 12/1998
WO WO 2015/134312 A1 9/2015

OTHER PUBLICATIONS

Search Report and Written Opinion dated Aug. 28, 2019 for PCT Application No. PCT/US19/36914, 18 pages.

*Primary Examiner* — Noah Chandler Hawk
(74) *Attorney, Agent, or Firm* — Patterson Thuente Pedersen, P.A.

(57) ABSTRACT

A three- or four-wheeled mobility walker/rollator including a foldable or collapsible frame assembly including a main or anterior frame assembly and a posterior frame assembly, three or four wheels coupled to the bottom or base of the frame assembly, and at least two crossbar handles coupled to the top of the frame assembly. The crossbar handles are placed one in front of the other with the first posterior crossbar handle being aligned with or slightly behind the middle of the back wheel posterior to the bottom of the walker frame. The crossbars can be of a sufficient width and curvature to provide a continuous support for the forearms when the user is standing, and can provide more frontal plane stability and balance during locomotion compared to the handles of a traditional walker.

14 Claims, 4 Drawing Sheets

(56) References Cited

U.S. PATENT DOCUMENTS

| | | | | |
|---|---|---|---|---|
| 7,866,677 | B1 * | 1/2011 | Rothstein | A61H 3/04 135/67 |
| 2002/0070533 | A1 | 6/2002 | Owens | |
| 2004/0222605 | A1 | 11/2004 | Sterns et al. | |
| 2010/0140893 | A1 * | 6/2010 | Menefee | A61H 3/04 280/87.041 |
| 2011/0023920 | A1 * | 2/2011 | Bolton | A61H 3/04 135/66 |
| 2011/0278809 | A1 * | 11/2011 | Turner | A61H 3/04 280/47.35 |
| 2013/0146111 | A1 * | 6/2013 | Gelfand | A61H 3/02 135/71 |
| 2014/0265256 | A1 * | 9/2014 | Rothstein | A61H 3/04 280/651 |
| 2015/0245973 | A1 * | 9/2015 | Liu | A61H 3/04 280/47.34 |
| 2015/0342822 | A1 * | 12/2015 | Osterhaus | A61H 3/04 280/657 |
| 2017/0112706 | A1 * | 4/2017 | Bruk | A61H 3/04 |

* cited by examiner

WALKER/ROLLATOR

FIELD OF TECHNOLOGY

Embodiments of the present invention relate generally to walkers and rollators, and more particularly to improvements in walker and rollators designs to improve postural alignment and therefore stability of the user during location.

BACKGROUND

A walker or walking frame is a tool for disabled or elderly people who need additional support to maintain balance or stability while walking. Typically, a walker includes a light-weight frame that is about waist high, and slightly wider than the user, creating a U-shaped or indented area for the user to stand within. The front two legs of the walker can have wheels attached, depending on the strength and abilities of the person using it.

Another type of tool, similar to the walker, is the rollator, also called a "wheeled walker." The rollator typically includes a main frame coupled to a posterior frame, with three or four large wheels, handlebars, and a built-in seat, which allows the user to stop and rest when needed. Rollators can also include a basket, permanently or removably coupled to the front of the main frame. Rollators are typically height adjustable and light-weight, yet sturdier than conventional walkers. The handlebars are equipped with hand brakes that can be lifted or pushed downward to instantly stop the rollator by engaging the front and/or rear wheels. The brakes can also be used in maneuvering the rollator; by braking one side while turning the rollator towards that side a much tighter turning radius can be achieved.

As indicated in a biomechanical analysis of rollator walking, published in BioMed, in 2006. "During rollator walking the hip becomes more flexed while the knee and ankle joints were less flexed/dorsiflexed. The ROM [range of motion] of the ankle and knee joints is reduced and there is a reduction in the knee extensor moment by 50%. The ankle plantarflexor and hip abductor moments were smaller when walking with a rollator. The angular impulse of the hip extensors are significantly increased during rollator-walking."

The traditional walker/rollator is designed to increase stability during locomotion, using the walker/rollator to extend the user's base of support (hereinafter "BOS"). Upper limb movements used during contralateral movement contribute significantly to frontal plane balance and postural stability during locomotion. However, the height, shape, and design of traditional walkers limit upper limb movement. The forearms and hands are placed outside the walker/rollator BOS, with the palms of the hands facing each other. The moment arm between the user's center of mass (hereinafter "COM") and the walker becomes longer and the knee extensor moment becomes shorter, causing the feet to stop striking the ground from heel to toe during the gait cycle.

The postural stability of the body during locomotion depends on the stability of its individual segments (arms and legs). The part of balance that is contributed by each segment is called a segment's partial equilibrium. Each segment has its own partial center of gravity (hereinafter "COG") and partial gravity line (hereinafter "LOG"). Any change in position of a partial COG produces a corresponding change in the common center of gravity and the LOG in the body. Movement that maintains the gravity line of the arms and legs during locomotion keeps the body's COM and COG low and centralized inside the BOS. Movement that reduces the ROM of the knee and ankle joints causes a reduction of the knee extensor moment during the gait cycle. When the angular impulse of the hip extensors are significantly increased during locomotion, a stooped, stiff posture with the head and neck bent forward develops causing a shuffle gait that is unrelated to age or disease.

People adapt physically and mentally to the environment in which they move and work. With every movement we make, our conscious brain strives to do better. Repetition and practice of a new motor skill or behavior causes the brain, and not just the body, to adapt. Procedural memory is a form of muscle memory. After 300-500 new attempts at a new motor skill or behavior, the body starts to adapt to the imposed demands placed upon it. New movement or motor behavior starts to become habitual in as little as three weeks. After four and a half months of new neural pathways, good or bad, become the default pathways that the body uses. The body's muscular skeletal system adapts physically to the specific demands placed upon it during locomotion. When there is unstable motion that does not maintain postural alignment and vertical orientation during locomotion, the body stops being able to repair itself from the stress imposed upon it. The skeletal bones become thinner and the skeletal muscles become weaker, the fascia surrounding the muscles and the joints becomes tight and less flexible, and the body stops producing enough joint nourishing, shock absorbing synovial fluid.

There remains a need for an improved walker or rollator design that improves a user postural alignment and therefore stability.

SUMMARY

Embodiments are directed to a three- or four-wheeled mobility walker/rollator including a vertically and/or horizontally foldable or collapsible frame assembly including a main or anterior frame assembly and a posterior frame assembly, three or four wheels coupled to the bottom or base of the frame assembly, and at least two crossbar handles coupled to the top of the frame assembly.

The crossbar handles can be height adjustable both in or one of height and laterally along the top of the frame assembly either together or independently from one another. The crossbar handles are placed one in front of the other with the first posterior crossbar handle being aligned with or slightly behind the middle of the back wheel posterior to the bottom of the walker frame. A gap can extend between the first and second crossbar handles.

The crossbars can be of a sufficient width and curvature to provide a continuous support for the forearms when the user is standing, and can provide more frontal plane stability and balance during locomotion compared to the handles of a traditional walker. For example, the crossbars can have a flattened or planar top surface, while having curved side surfaces. This allows the user to rest their forearms on the crossbars, or to comfortably grasp one of the crossbars during locomotion, either position keeping the user posturally aligned.

Either the first or second crossbar handle can be used to push the walker, and the walker can be pushed with one or both hands. The hands are positioned close to each other with the palms facing downward during locomotion. The crossbars are hingedly coupled to the top of the frame assembly, and lock in place horizontally across the frame assembly during use. When the walker is folded, the crossbars are unlocked and can be hindgedly moved to a vertical position and optionally attached to the main frame.

The walker also includes one or more brake handles under the crossbar handles that, when engaged, lock the rear wheels to inhibit rolling or movement of the walker. When the brake handles are locked, they can also be utilized to assist the user when sitting or standing. Additionally or alternatively, the crossbar handles can be height adjusted, such as by telescoping members of the anterior and/or posterior frame assembly or other known mechanisms, to assist the user to move between sitting and standing positions. For example, when a user is going to sit, they may adjust the crossbar handles, and the frame telescopes downward such that the handles are in a lower position to aid in lowering the body into the seated position. Then, the user can grasp the lower positioned handles to aid in pulling oneself into a standing position, and then readjust the crossbar handles to the original, higher position.

The walker can also include an optional basket removably or permanently affixed to a rear interior portion of the posterior frame assembly, a foldable and/or removable tray basket and shelf in front, and/or one or more optional foldable shelves and/or fabric pouches which attach to an interior of the frame assembly of the walker. Furthermore, the walker can include one or more open or closeable hooks coupled to the frame. The hooks can optional include a hinged section for shifting the hook from an open position to hang or remove an item from to a closed position in which the hinged section is secured to the frame to prevent the hung item from slipping off of the hook.

In yet other embodiments, the walker can optional include one or more tube type elements coupled to the frame for placing other ambulatory aids, such as canes, crutches, and the like. For example, a first and second tubular members are coupled to a top portion of the frame, while corresponding aligned first and second tubular members are coupled to a lower portion of the frame. This allows one to place a cane or other member into the corresponding members during locomotion. The frame can include more or less of the tubular members as desired.

The human body is a biomechanical movement machine designed to keep its COM, COG, and LOG centralized inside its BOS during locomotion. The walker/rollator of the embodiments is designed to maintain the user's vertical orientation and postural stability without extending the user's arms outside the walker or body's BOS. The user's hands and arms are positioned at the back of the walker close to the body's COM. The positioning of the elbows and arms close to the body's COM keeps the weight of the arms in the elbows. The shoulder joints are aligned with and under the shoulder girdle during locomotion. The user's COM is more centralized inside the body's BOS during all phases of the gait cycle. The user's head, line of sight, and COM maintain vertical orientation during locomotion. The body's COG and LOG stay centralized and move forward in the direction of movement and not towards the ground. When the head, line of sight, and COM are in the direction of movement and not towards the ground during locomotion, the body has more postural stability, frontal plane balance, and equilibrium. The walker of embodiments described herein allows the feet to strike the ground from heel to toe, more closely reflecting the normal gait cycle than when using a traditional walker.

The posterior frame of the walker does not have an accessible U-shaped or indented area between the wheels like traditional walkers/rollators. Rather, this walker/rollator is square-backed with a basket incorporated into the posterior frame for placing items in or for placing a mesh or other liner in. The square-backed posterior design of the walker/rollator frame keeps the arms from extending away from the body's COM. The shorter moment between the arms and the walker keeps the user vertically oriented and stops the user's trunk from flexing forward and downward over the walker frame during locomotion. The alignment and positioning of the hands close to each other and over and around the crossbar handles with the palms facing downward during locomotion allows the head to stay positioned over the shoulders and hips.

The height, shape, and design of the walkers described herein create a smaller moment arm between the walker and the user's COM. This shorter moment arm between the user and the walker/rollator gives the user a mechanical advantage as well as more sensory and proprioceptor input during both locomotion and when stationary. When the vertical LOG in the body is maintained during locomotion, the line of sight stays in the direction of movement during locomotion. The walkers described herein provide and unmet need because it increases frontal plane balance, postural stability, and vertical equilibrium, while increasing proprioceptor and sensory input during locomotion.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
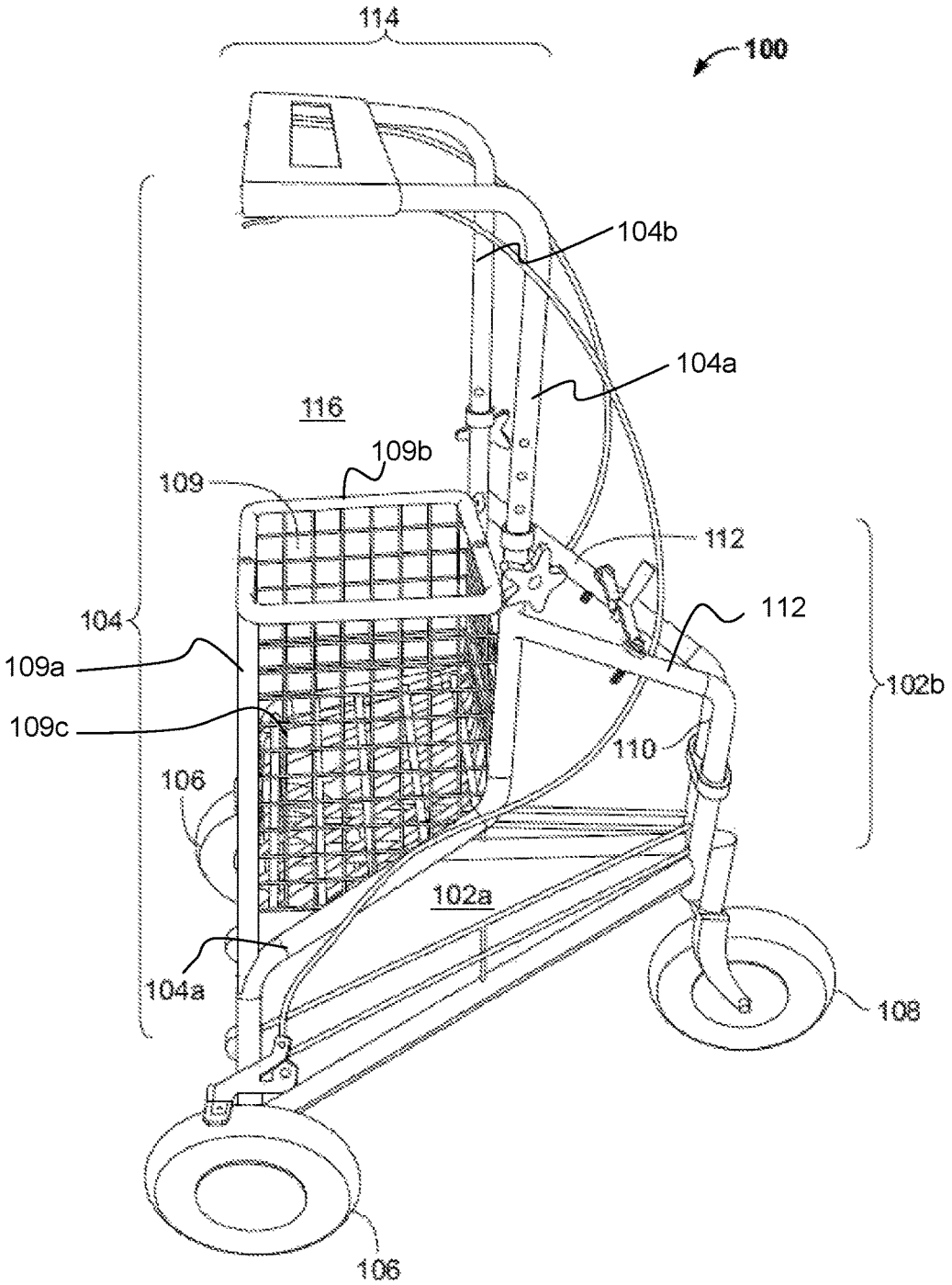
FIG. 1 is a perspective view of a 3-wheeled walker according to an embodiment of the invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION

Figure 2:
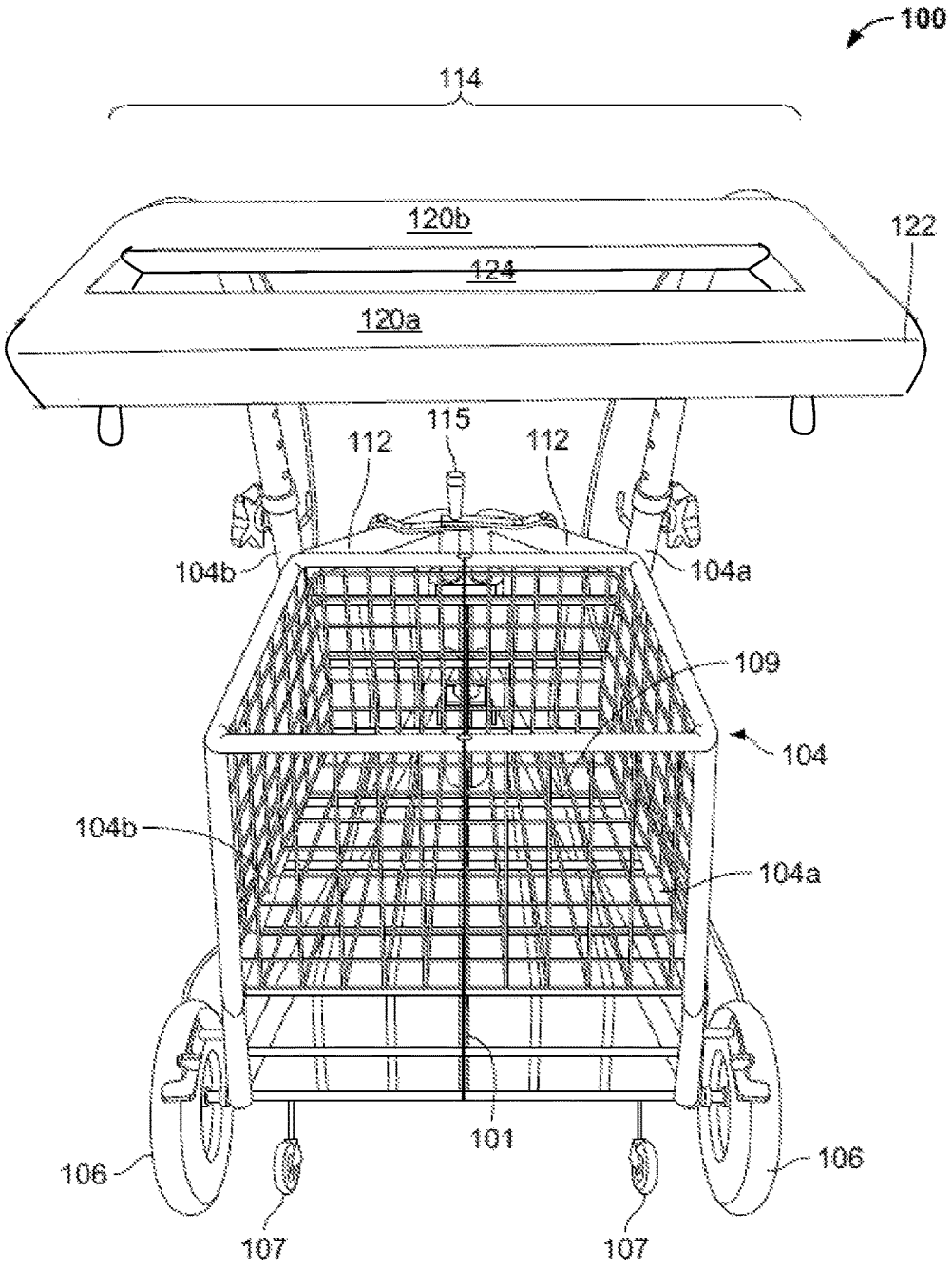
FIG. 2 is a rear view of the 3-wheeled walker of FIG. 1.
Figure 3:
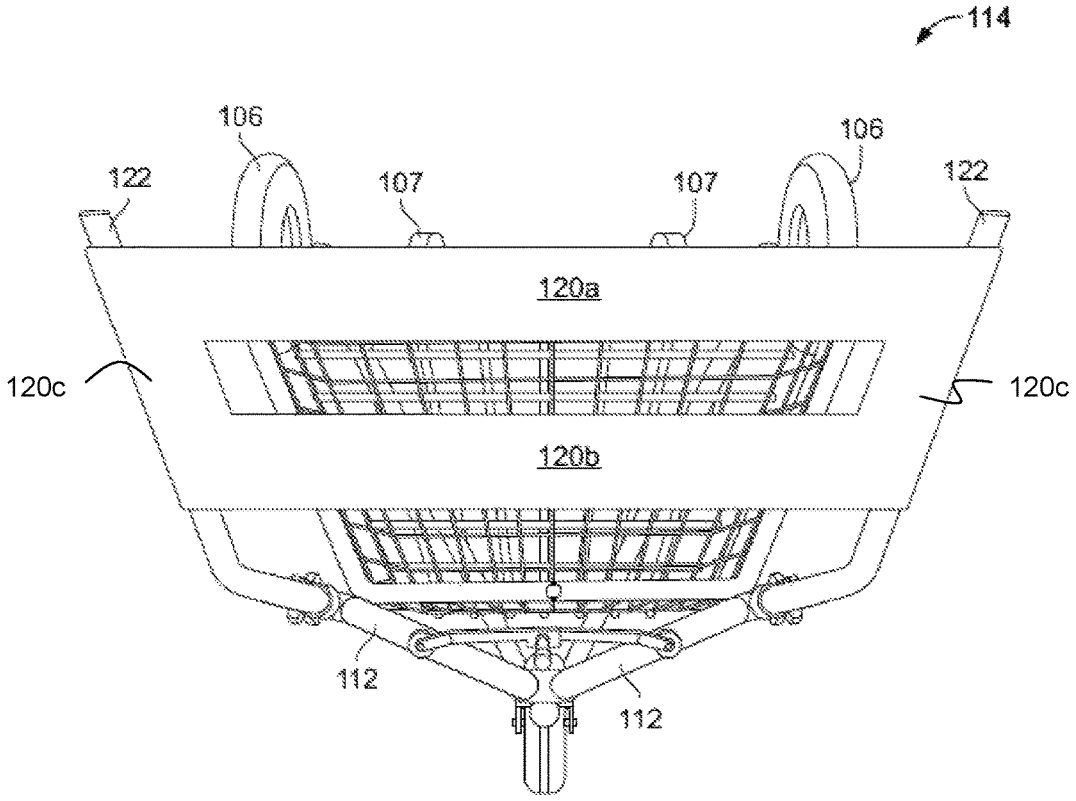
FIG. 3 is a top view of the 3-wheeled walker of FIG. 1.

Referring to FIGS. 1-3, in an embodiment directed to a three-wheeled version of the walker 100, walker 100 includes an anterior frame assembly 102 and a posterior frame assembly 104. Anterior frame assembly 102 includes a bottom or base frame assembly 102*a* and an anterior frame portion 102*b*. Base frame assembly 102*a* can generally form a triangular base in the case of a three-wheel version as depicted, or in an alternative embodiment, a square, rectangular, or other quadrilateral base in the case of a four-wheel version. Two spaced apart rear wheels 106 are coupled to base frame assembly 102*a*, one at each intersection of frame members, while a single wheel 108 is coupled to an apex at the front of base frame assembly 102*a*, therefore forming a tripod. Preferably, only front wheel 108 pivots in use.

Optionally, base frame assembly 102*a* can comprise one or more anti-tip wheels 107 which prevent walker 100 from tipping backward, such as on a steep incline.

Anterior frame portion 102*b* includes one or more vertical members 110 extending from the apex of base frame assembly 102*a*, and connecting members 112, which connect anterior frame portion 102*b* to posterior frame assembly 104. An optionally foldable and/or removable basket and shelf (not shown) can be operably coupled to walker 100 on top of anterior frame portion 102*b*.

A bottom of posterior frame assembly 104 is approximately six to eight inches off the ground, depending on the size of the wheels, and extends across each side of walker 100 to connect to base frame assembly 102*a* at a location of wheels 106. Members 104*a*, 104*b* of posterior frame assembly 104 curve upward and inward toward each other as they rise to intersect and connect to connecting portion 112 of anterior frame portion 102*b*. Members 104*a*, 104*b* extend further upward and then curve rearward and outward from each other to form top portion 114 of posterior frame assembly 104. In other words, top portion 114 widens from anterior to posterior of walker 100, and from about 12 inches wide at the most anterior portion to about 16-17 inches wide at the most posterior portion, in one non-limiting embodiment. Top portion 114 extends about 10-12 inches from the most anterior portion to the most posterior portion.

Unlike traditional walkers and rollators which include an indented area that extends forward from rear wheels and in which the user stands, posterior frame assembly 104 includes a basket area 109 formed of basket frame vertical members 109*a* and horizontal members 109*b*, filled in by grid members 109*c* to block access to this indented area 116, keeping the user aligned properly. Basket area 109 can instead be utilized by itself to carry larger items, or by placing a pouch, nylon, or any kind of fabric or mesh material to line basket area 109, and optionally one or more adjustable shelves for carrying a user's items.

Two crossbar handles 120*a*, 120*b* are positioned at top portion 114 of posterior frame assembly 104, connected by forearm bars 120*c* on each side of crossbar handles 120*a*, 120*b*. Top portion 114 is aligned underneath second crossbar handle 120*b* of walker 100, and top portion 114 terminates at first crossbar handle 120*a*. Crossbar handles 120*a*, 120*b* are placed one in front of the other with posterior crossbar handle 120*a* being aligned with or slightly behind the middle of the back wheel 106 posterior to the base frame assembly 102*a*. A gap 124 can extend between and is bordered by crossbar handles 120*a*, 120*b*, and forearm bars 120*c*. Crossbar handles 120*a*, 120*b* can be height adjustable along top portion 114 either together or independently from one another.

In a particular embodiment, referring to FIG. 3, first crossbar handle 120*a*, which comprises a flat, non-tubular top handle (with rounded edges), has a length of about 16 to 17 inches, extending across frame members 104*a*, 104*b*. Second crossbar handle 120*b*, which also comprises a flat, non-tubular top handle (with rounded edges), has a length of about 14 inches, extending across frame members 104*a*, 104*b*. Gap 124 can extend about two to three inches and widens from about 14 inches at an anterior side to 16-17 inches at a posterior side. Forearm bars 120*c* can have a constant width of about 3-4 inches, and also have a flat, non-tubular profile or cross section.

Crossbar handles 120*a*, 120*b* can be of a sufficient width and curvature to provide a continuous support for the forearms when the user is standing, and can provide more frontal plane stability and balance during locomotion compared to the handles of a traditional walker. Either first or second crossbar handle 120*a*, 120*b* can be used to push the walker, and the walker can be pushed with one or both hands. The hands are positioned close to each other with the palms facing downward during locomotion. Crossbar handles 120*a*, 120*b* are optionally hingedly coupled to top portion 114, and lock in place horizontally across top portion 114 during use. When walker 100 is folded along folding axis 101 and upon actuation of folding mechanism 115 such that its width is reduced so as to fit into a vehicle, crossbar handles 120*a*, 120*b* are unlocked and can be hindgedly moved to a vertical position and optionally attached to the main frame.

Walker 100 also includes one or more brake handles 122 under crossbar handles 120*a*, 120*b* that, when engaged, lock rear wheels 106 to inhibit rolling or movement of walker 100. When brake handles 122 are locked, they can also be utilized to assist the user when sitting or standing. Additionally or alternatively, crossbar handles 120*a*, 120*b* can be height adjusted to assist the user to move between sitting and standing positions. For example, when a user is going to sit, they may adjust crossbar handles 120*a*, 120*b* to a lower position to aid in lowering the body into the seated position. Then, the user can grasp optional lower positioned handles (not shown) to aid in pulling oneself into a standing position, and then readjust crossbar handles 120*a*, 120*b* to the original, higher position.

Optionally, one or more cane or crutch holders 123 (depicted in a non-limiting example in FIG. 4) can be placed one on each of the inside support frames 104*a, b*, in front of crossbar handle 102*b*. Corresponding tube portions 125 align with holders 123 such that a crutch or cane can extend along walker 100 and be secured in at least two portions. The base frame assembly 102*b* can be solid or a small grid or mesh, and positioned so that when the crutch or cane is placed or removed, the bottom of the same does not interfere with wheels 106, 108, frames 102, 104, and/or handles 102 of walker 100.

Optionally, walker 100 can include small solar or battery powered lights (not shown) on main frame 102 and/or posterior frame 104 of walker 100, open or hinged hooks, and/or clip pockets on the inside and/or outside of frames 102 and/or 104 for attaching small items, such as a cell phone, wallet, portable speaker, pedometer, purse, or the like. Other optional features can include, but are not limited to, a cup holder coupled to basket 109, and/or a water bottle holder coupled to the outside of posterior frame 104 of walker 100.

Figure 4:
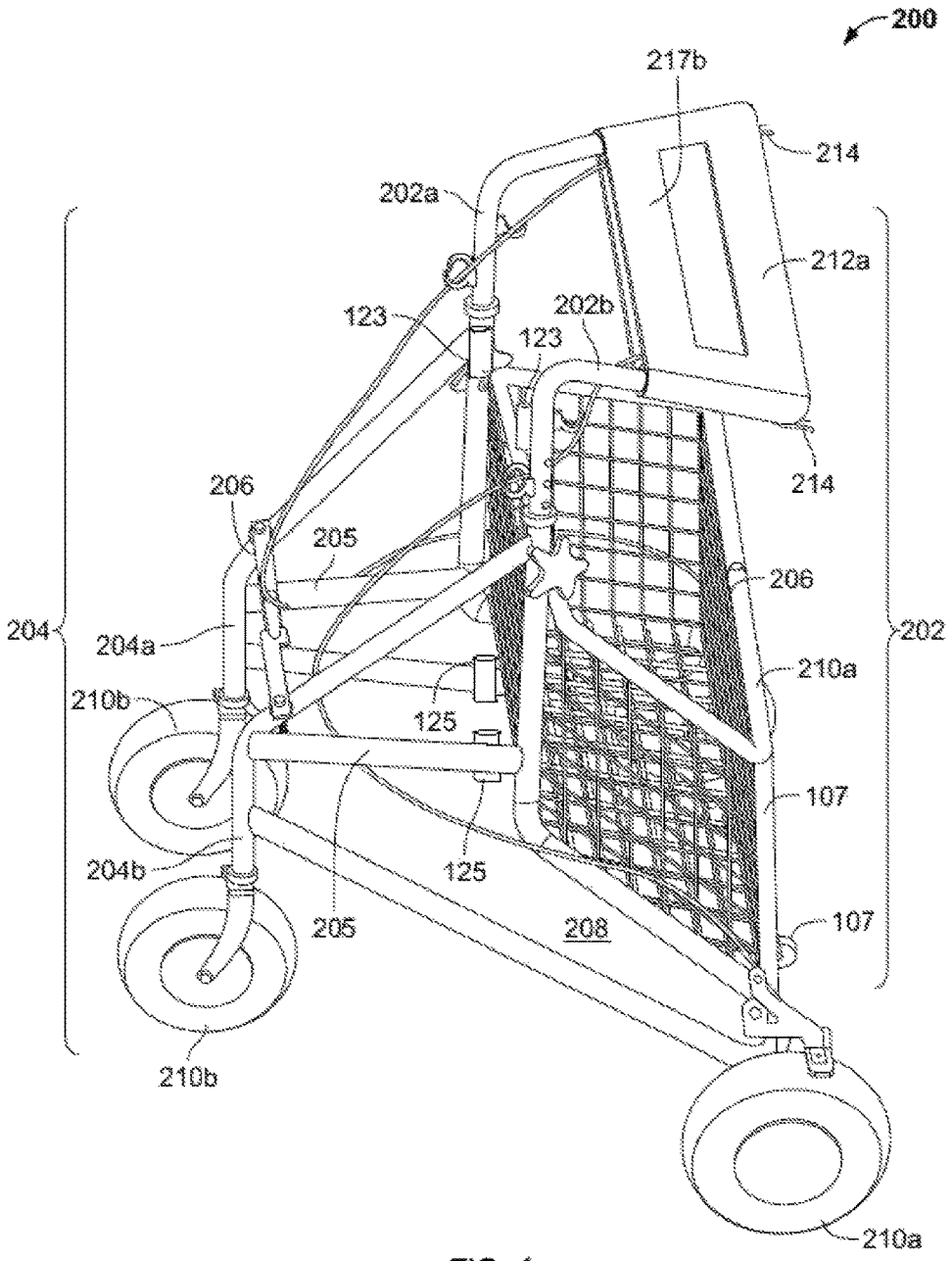
FIG. 4 is a perspective view of a 4-wheel walker according to an embodiment of the invention.

Now referring to FIG. 4, a walker 200 generally comprises a posterior frame 202 comprising at least two vertical members 202*a*, 202*b* and a parallel anterior frame 204 comprising at least two vertical members 204*a*, 204*b* and one or more support members 205. A wheel 210 is coupled to each corner of anterior frame 204 and posterior frame 202, thereby defining two rear wheels 210*a* and two front wheels 210*b*. In embodiments, only front wheels 210*b* pivot about each of members 204*a*, 204*b*. Posterior frame 202 is continuous from wheel to wheel without a U-shaped or indented area. Walker 200 further includes one or more baskets 206 and a bottom platform 208, each coupled to and extending between posterior frame 202 and anterior frame 204.

In an embodiment, anterior frame 204 has a height substantially equal to a height of posterior frame 202, such as, for example, 24 inches. Walker 200 narrows from back to front such that the rear wheels 210*a* are spaced farther apart from each other than the front wheels 210*b*. More particularly, anterior frame 204 is less in width than posterior frame 206 such that basket(s) 206 are coupled to an exterior surface of members 202*a* of posterior frame 202. In a particular example, a width of anterior frame 204 is approximately 14 inches, while a width of posterior frame 202 is approximately 16 inches.

In the embodiment depicted in FIG. 3 and well as the embodiment of FIGS. 1-3, walker 200 is collapsible by folding frame members 202*a* and 204*b* by release mechanism 206, such that the frames fold along a vertical axis so that a user can fit walker 200 in a trunk or a back seat of a vehicle. In other embodiments, walker 200 is collapsible in the vertical direction such that its height is reduced.

Walker 200 also includes crossbar handles 212*a*, 212*b* coupled to a top end of each of vertical members 202*a*, 202*b* of posterior frame 202. Crossbar handles 212 are joined together at the top and outside edges of members 202*a*, 202*b* to provide a continuous support for the forearms when the user is standing, resulting in more frontal plane stability and balance. The back of posterior crossbar handle 212*a* is posterior to posterior frame 202 and aligns behind the middle or just posterior to rear wheels 210*a*.

In embodiments, walker 200 also includes one or more brake handles 214 under or on crossbar handles 212*a*, 212*b* that, when engaged, lock rear wheels 210*a* to inhibit rolling or movement of walker 200. When brake handle(s) 214 are locked, they can also be utilized to assist the user when sitting or standing. Additionally or alternatively, crossbar handles 212*a*, 212*b* can be height adjusted to assist the user to move between sitting and standing positions. For example, when a user is going to sit, they may adjust crossbar handles 212*a*, 212*b* to a lower position to aid in lowering the body into the seated position. Then, the user can grasp lower positioned handles (not shown) to aid in pulling oneself into a standing position, and then readjust crossbar handles 212*a*, 212*b* to the original, higher position.

In embodiments, walker 200 can further optionally include any of a variety of accessories, such as, hooks 216 for hanging purses or bags, trays 218 with or without cup holders 220, structure defining parallel openings 123, 125 for placing canes and/or crutches, or any combination thereof.

The height, shape, and design of the walkers described herein create a smaller moment arm between the walker and the user's COM. This shorter moment arm between the user and the walker/rollator gives the user a mechanical advantage as well as more sensory and proprioceptor input. When the vertical LOG in the body is maintained during locomotion, the line of sight stays in the direction of movement during locomotion. The walkers described herein provide and unmet need because it increases frontal plane balance, postural stability, and vertical equilibrium, while increasing proprioceptor and sensory input during locomotion.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. A walker comprising:

a base frame assembly comprising at least three support members;

an anterior frame assembly including first and second support members extending upwardly from an anterior side of the base frame assembly;

a posterior frame assembly including first and second support members, the first and second support members being coupled to the first and second support members of the anterior frame assembly and extending from a posterior side of the base frame assembly;

at least three wheels, a wheel being coupled to the base frame assembly at each intersection of the at least three support members of the base frame assembly; and a top crossbar assembly including a first non-tubular crossbar extending between and over a top portion of each support member of the posterior frame assembly and substantially over the rear wheels, and a second non-tubular crossbar spaced anterior from the first crossbar, wherein each of the first and second non-tubular crossbars have a planar top surface and curved side surfaces;

a first and second brake handle positioned on an end of each support member of the posterior frame assembly, wherein the top crossbar assembly is configured to align and position hands of a user close to each other and over and around the crossbars with the palms facing downward during locomotion thereby allowing the user's head to stay positioned over the user's shoulders and hips.

2. The walker of claim 1, wherein the first and second support members of the anterior frame assembly extend vertically from the base frame assembly and then rearwardly to intersect first and second support members of the posterior frame assembly.

3. The walker of claim 2, wherein the first and second support members of the posterior frame assembly extends vertically and forwardly from the base frame assembly to define a first portion, and then curve to extend substantially vertically to define a middle portion, and then curve rearwardly to extend substantially horizontally to define the top portion, and to which the top crossbar assembly is coupled.

4. The walker of claim 3, wherein the first and second support members of the anterior frame assembly connect to the first and second support member of the posterior frame assembly along the middle portion of the posterior frame assembly.

5. The walker of claim 3, wherein the walker further comprises:

a basket assembly including a basket frame coupled to and extending from the first and middle portion of the posterior frame assembly, wherein the basket assembly is configured to prevent the user's arms from extending away from the user's body's COM.

6. The walker of claim 5, wherein the basket assembly further includes a plurality of grid members extending between the basket frame.

7. The walker of claim 1, wherein the crossbars are spaced from each other to form a gap extending about two to three inches.

8. The walker of claim 1, further comprising:

at least one anti-tip wheel coupled to the posterior side of the base frame assembly.

9. The walker of claim 8, comprising two anti-tip wheels spaced equally from a center of a support member defining the posterior side of the base frame assembly.

10. The walker of claim 1, wherein the base frame assembly comprises three support members to define a triangular base frame, a first and second wheel of the at least three wheels being positioned on each end of the posterior frame assembly, and a third wheel of the at least three wheels being positioned at an anterior apex of the base frame assembly.

11. The walker of claim 1, wherein the base frame assembly comprises four support members to define a quadrilateral base frame, and four wheels, one wheel being coupled to each corner of the quadrilateral base frame.

12. A walker comprising:

a base frame assembly comprising at least three support members;

an anterior frame assembly including first and second support members extending upwardly from an anterior side of the base frame assembly;

a posterior frame assembly including first and second support members, the first and second support members being coupled to the first and second support members of the anterior frame assembly and extending from a posterior side of the base frame assembly;

at least three wheels, a wheel being coupled to each intersection of the at least three support members of the base frame assembly;

a top crossbar assembly including a first non-tubular crossbar extending between and over a top portion of each support member of the posterior frame assembly and substantially over the rear wheels, and a second non-tubular crossbar spaced anterior from the first crossbar, wherein each of the first and second non-tubular crossbars have a planar top surface and curved side surfaces; and a basket assembly including a basket frame coupled to and extending from the posterior frame assembly, wherein the basket assembly is configured to prevent the user's arms from extending away from the user's body's COM.

13. The walker of claim 12, wherein the top crossbar assembly is configured to align and position hands of a user close to each other and over and around the crossbars with the palms facing downward during locomotion thereby allowing the user's head to stay positioned over the user's shoulders and hips.

14. The walker of claim 13, wherein the basket assembly further includes a plurality of grid members extending between the basket frame.

* * * * *